US005156752A

United States Patent [19]

Gimpera

[11] Patent Number: 5,156,752

[45] Date of Patent: Oct. 20, 1992

[54] ELONGATED STATOR AND ROTOR MEMBERS WITH ELONGATED SLOTS

[75] Inventor: José Gimpera, Wiesbaden, Fed. Rep. of Germany

[73] Assignee: Didier-Werke AG, Wiesbaden, Fed. Rep. of Germany

[21] Appl. No.: 728,534

[22] Filed: Jul. 11, 1991

Related U.S. Application Data

[62] Division of Ser. No. 623,363, Dec. 6, 1990.

[30] Foreign Application Priority Data

Jan. 11, 1990 [DE] Fed. Rep. of Germany ..... 4000656

[51] Int. Cl.[5] ..... B22D 41/14

[52] U.S. Cl. ..... 222/598; 222/597

[58] Field of Search ..... 222/597, 598, 599; 266/236; 164/437, 337, 335

[56] References Cited

U.S. PATENT DOCUMENTS

| | | | |
|---|---|---|---|
| 4,913,324 | 4/1990 | Lührsen | 222/598 |
| 4,932,570 | 6/1990 | Gimpera | 222/598 |
| 4,949,886 | 8/1990 | Lührsen et al. | 222/598 |
| 4,993,608 | 2/1991 | Thörner | 164/437 |

FOREIGN PATENT DOCUMENTS

| | | |
|---|---|---|
| 3508218 | 11/1986 | Fed. Rep. of Germany . |
| 3805071 | 8/1989 | Fed. Rep. of Germany . |
| 3809071 | 9/1989 | Fed. Rep. of Germany . |
| 671716 | 9/1989 | Switzerland . |

*Primary Examiner*—Scott Kastler

*Attorney, Agent, or Firm*—Wenderoth, Lind & Ponack

[57] ABSTRACT

An elongated nozzle assembly for closing and/or regulating the discharge from a metallurgical vessel of molten metal in the form of a wide strip includes refractory tubular stator and rotor members each having extending through a tubular wall thereof a discharge opening in the form of a slot elongated in the direction of coincident longitudinal axes thereof. The stator and rotor members are assembled with one member fitting in a sealing manner within the other member, thus forming inner and outer members. The inner member has therein a cavity elongated in the direction of the axes of the members and into which opens the discharge opening of the inner member. A first longitudinal end of the cavity is closed by an end wall of the inner member. A second longitudinal end of the cavity is opened axially through an inlet opening in the respective longitudinal end of the inner member. The inlet opening communicates via the cavity with the discharge opening of the inner member.

12 Claims, 3 Drawing Sheets

ELONGATED STATOR AND ROTOR MEMBERS WITH ELONGATED SLOTS

This is a divisional application of Ser. No. 07/623,363, filed Dec. 6, 1990.

BACKGROUND OF THE INVENTION

The present invention relates to member of an elongated nozzle assembly for closing and/or regulating the discharge from a metallurgical vessel of molten metal in the form of a wide strip. More particularly, the present invention relates to refractory tubular stator and rotor members that can be assembled together so that the rotor member is rotatable relative to the stator member in a molten metal-tight manner. The rotor and stator members have therethrough discharge openings in the form of slots elongated in the direction of the longitudinal axes of the members, such that upon rotation of the rotor member relative to the stator member, the discharge opening of the rotor member may be brought into and out of alignment with the discharge opening of the stator member, thereby closing and/or regulating the discharge of the molten metal through the nozzle assembly.

An elongated nozzle assembly is disclosed in German DE 38 05 071 A1 wherein each of the rotor and stator members has elongated discharge openings but also elongated inlet openings. The inlet and discharge openings are positioned diametrically opposite each other in each of the members, relative to the coincident longitudinal axes of the two members. When the assembly is in its open position, the molten metal flows radially through the elongated inlet openings in the two members, then radially through the internal cavity of the inner member, and radially through the elongated discharge openings in the two members. The internal cavity within the inner member does not itself contribute to the distribution of the molten metal via the elongated discharge openings. Additionally, the fact that each member has therein two elongated openings tends to weaken the structure of each of the members and thereby the structure of the nozzle assembly.

German DE 38 09 071 A1 describes a nozzle assembly wherein the need for two elongated openings in the rotor member that is positioned as the inner member is avoided. A recess in the rotor member forms a connecting channel between an inlet opening and a discharge opening in the outer, stator member. However, in this arrangement it also is necessary for the outer member to have two elongated openings. Also, the cavity within the inner member does not contribute to the distribution of the melt to the discharge opening. The recess is positioned relatively free to the sealing surface of the outer member as a result of which it is subject to wear by the molten metal.

Additionally, German DE 35 08 218 A discloses a control element for a slotted nozzle wherein the flow of molten metal is adjusted by regulating the viscosity of the molten metal by heat. A stopping or closing element is not shown.

Swiss CH 671,716 discloses a device for pouring or discharging thin strips or foils of metal wherein a tubular nozzle body is provided with an elongated slot. One face of the nozzle body is closed, and molten metal flows in through another face of the nozzle body. To control the discharge of the molten metal, the level of the molten metal in the metallurgical vessel is controlled, or the molten metal is maintained under pressure when the nozzle body is arranged above the level of the molten metal. The nozzle body does not form a closing and/or regulating mechanism.

SUMMARY OF THE INVENTION

With the above discussion in mind, it is an object of the present invention to provide refractory elongated tubular stator and rotor members for use in an elongated nozzle assembly of the above type but whereby it is possible to overcome the above and other prior art disadvantages.

It is a more specific object of the present invention to provide, for use in such an elongated nozzle assembly whereby it is possible to close and/or regulate the discharge from a metallurgical vessel of molten metal in the form of a wide strip, such refractory tubular stator and rotor members each having extending through a tubular wall thereof a discharge opening in the form of a slot elongated in the direction of coincident longitudinal axes of the two members.

It is a yet more specific object of the present invention to provide such stator and rotor members by which it is possible to prevent the molten metal from flowing radially to the coincident axes through the internal cavity of an inner such member, as a result of which the stability of the members is improved.

It is a further object of the present invention to provide such stator and rotor members wherein the molten metal is caused to flow through the inner member in a generally longitudinal direction through the internal cavity thereof to the elongated discharge openings.

The above and other objects of the present invention are achieved by the provision that the internal cavity within the inner member is elongated in the direction of the coincident axes of the two members, with the discharge opening of the inner member opening into such internal cavity. The cavity has a first longitudinal end closed by an end wall of the inner cavity and a second longitudinal end open axially through an inlet opening in the respective longitudinal end of the inner member. The inlet opening communicates in a generally longitudinal direction via the cavity with the discharge opening of the inner member.

In accordance with the above features of the present invention, the molten metal enters the internal cavity within the inner member from one end of the inner member, i.e. through the inlet opening therein. As a result, there is no necessity of providing in the inner member an inlet slot parallel to the elongated discharge opening therein. Similarly, there is no necessity of providing in the outer member an inlet slot extending parallel to the elongated outlet opening. As a result, the stability and useful life of both members is improved significantly. This is particularly important since the two members are assembled in a telescoping manner and the rotor member must be readily rotatable about the common longitudinal axes of the two members in order to ensure the desired closing and/or regulating function of the nozzle assembly. In accordance with the above features of the present invention the relative alignment of the single elongated discharge opening in the rotor member with the single elongated discharge opening of the stator member can be controlled with delicate sensitivity, and if necessary such alignment can be completely closed to interrupt discharge of the molten metal. Additionally, it is possible to move the rotor member axially relative to the stator member, as a result of which it is possible to regulate or control the width of the molten metal strip being discharged.

As indicated above, the molten metal does not pass diametrically or radially through the internal cavity of the inner member, but rather flows into and through the cavity substantially axially or longitudinally thereof. The internal cavity thus forms in essence a buffer that guarantees that the molten metal will be at substantially the same pressure throughout the entire length of the elongated discharge openings. Therefore, it is ensured that the molten metal being discharged will form a metal strip or sheet of uniform thickness. It particularly will be possible to ensure that edge regions of such strip or sheet will be of uniform thickness. The assembly of the present invention therefore is suitable for end dimensional related continuous casting operations, particularly continuous strip casting or continuous thin slab casting wherein, without this advantage of the present invention, subsequent rolling operations would be necessary. Furthermore, due to the fact that it is possible to so accurately control the thickness of the molten metal strip being discharged, the need for controlling the velocity of a cooling drum or conveyor downstream of and receiving the metal strip from the assembly of the invention becomes substantially less important.

A further advantage of the structural arrangement of the present invention is that when the rotor member is in the closed position, any metal remaining in the cavity in the inner member will be in direct communication with the molten metal remaining within the interior of the metallurgical vessel. As a result, any such metal remaining in the cavity will be much less likely to solidify therein, and therefore the nozzle assembly of the present invention will be much less likely to become obstructed.

As a result of the above structural features of the present invention, there is provided within the internal cavity in the inner member a flow zone extending in the direction of the axes of the members between the inlet opening in the inner member and that longitudinal end of the discharge opening of the inner member closest to such inlet opening. This flow zone, extending longitudinally within the cavity, operates to orient the flow of molten metal axially within the cavity in a direction toward the closed end thereof, i.e. in a direction transverse to the discharge openings. This feature facilitates the achievement of a uniform pressure of the molten metal throughout the entire length of the elongated discharge openings. For the same purpose and to achieve the same function, the internal cavity within the inner member includes an axially extending accumulation chamber between the closed end of the cavity and that longitudinal end of the discharge opening of the inner member closest to the such closed end. Thus, such accumulation chamber tends to ensure equalized pressure of the molten metal throughout the entire length of the elongated discharge openings.

BRIEF DESCRIPTION OF THE DRAWINGS

Other objects, features and advantages of the present invention will be apparent from the following detailed description, taken with the accompanying drawings, wherein.

DETAILED DESCRIPTION OF THE INVENTION

Figure 1:
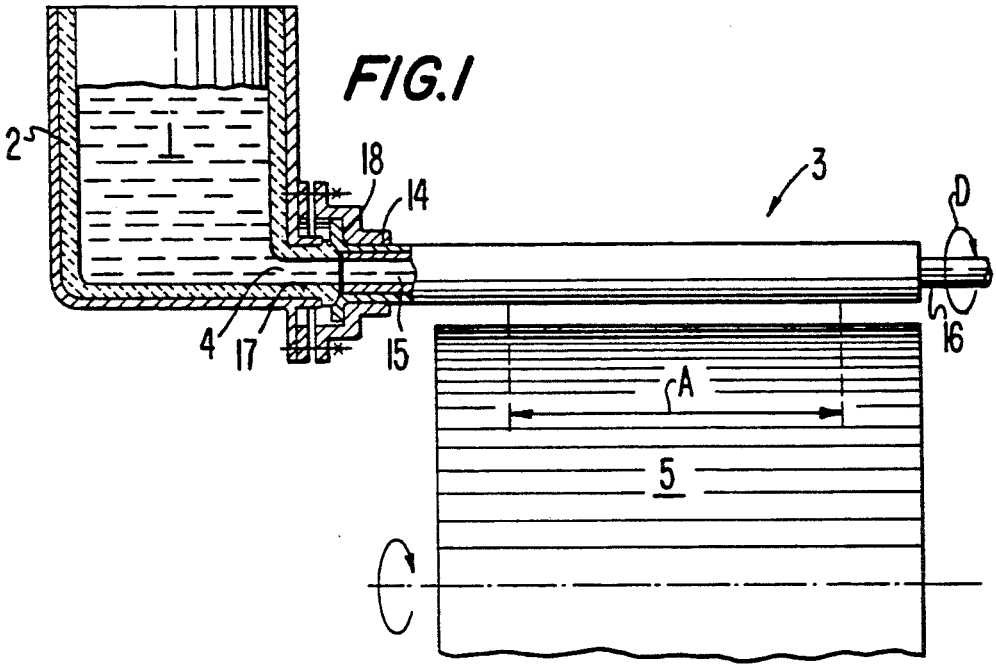
FIG. 1 is a schematic view, partially in section, illustrating an elongated nozzle assembly including stator and rotor members according to a first embodiment of the present invention and shown mounted externally of a metallurgical vessel.

In FIG. 1 there is shown schematically a metallurgical vessel 2 containing molten metal 1. At the bottom of the vessel 2 there is provided a laterally extending discharge spout 4 to the exterior of which is connected an elongated nozzle assembly 3 in accordance with the present invention for discharging the molten metal in the form of a wide strip. FIG. 1 also schematically illustrates a chill or cooling roller or a cooling conveyor 5 positioned adjacent the assembly 3 for receiving the metal strip discharged therefrom. The roller or conveyor 5 draws off the metal strip discharged from assembly 3. These features in and of themselves are generally conventional and would be well understood by one skilled in the art.

Figure 2:
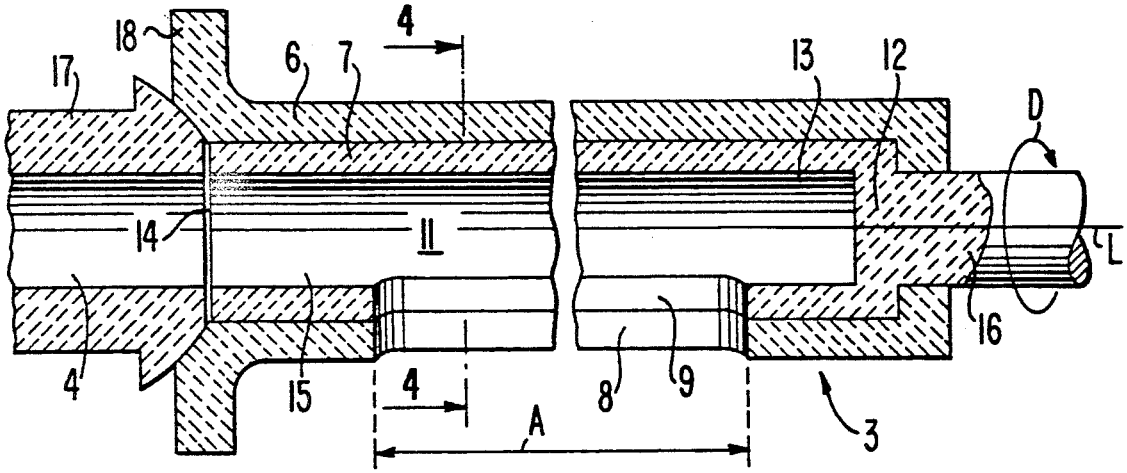
FIG. 2 is an enlarged sectional view of the elongated nozzle assembly of FIG. 1.
Figure 4:
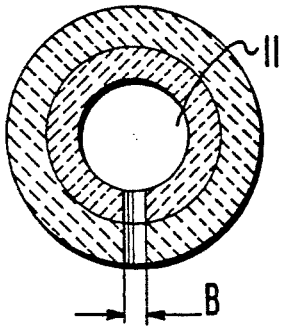
FIG. 4 is a sectional view taken along line 4—4 of FIG. 2 or of FIG. 3.

As shown in FIG. 2 however the elongated nozzle assembly 3 of the present invention includes a refractory tubular stator member 6 having extending through a tubular wall thereof a discharge opening 8 in the form of a slot elongated in a direction parallel to the longitudinal axis L of the stator member. In the embodiment of FIG. 2, stator member 6 is an outer member within which is positioned as an inner member a refractory tubular rotor member 7 having extending through a tubular wall thereof a discharge opening 9 in the form of a slot elongated in the direction of a longitudinal axis L of the rotor member. As illustrated, the axes of the members 6, 7 are coincident. The members 6, 7 are assembled as illustrated with rotor member 7 positioned within stator member 6. Stator member 6 and rotor member 7 have respective inner and outer surfaces that seal in a molten metal-tight manner relative to each other. It will be seen that rotor member 7 is rotatable about coincident axes L as indicated by arrow D relative to stator member 6 to bring discharge opening 9 of rotor member 7 into and out of alignment with discharge opening 8 of stator member 6. Thereby, it is possible to close the discharge of molten metal and/or to regulate the thickness of the molten metal strip being discharged. It furthermore is to be understood that the rotor member may be movable axially relative to the stator member, i.e. in opposite directions parallel to coincident axes L, and thereby to regulate the relative width of the molten metal strip being discharged, i.e. from a maximum width A equal to the longitudinal dimension of both of discharge openings 8, 9. As shown in FIG. 4, the discharge openings in the two members have the same width B. It thus is possible by rotation of the rotor member to regulate the thickness of the discharged metal strip.

As shown in FIG. 2, the outer member, i.e. the stator member 6, has extending outwardly therefrom an annular flange 18 employed for mounting the assembly 3 against the outer end of a nozzle 17 defining spout 4. Also, the outer end of rotor member 7 has extending therefrom a portion 16 fitting through an opening in stator member 6 and by which it is possible to rotate the rotor member in direction D about axes L. In the embodiment of FIG. 2, since the stator member 6 is the outer member, its discharge opening 8 is aligned in a fixed manner relative to roller or conveyor 5.

Figure 3:
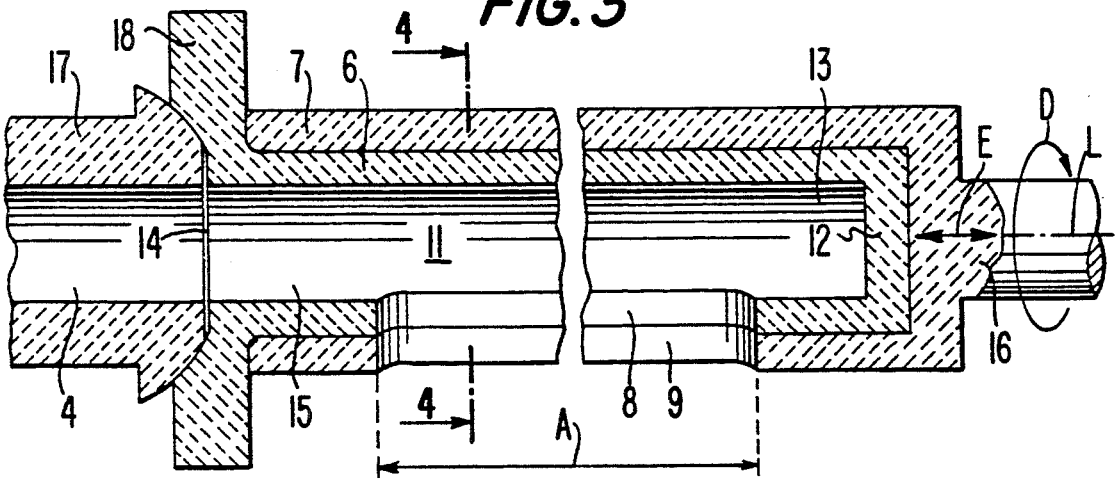
FIG. 3 is a view similar to FIG. 2 but of a modified embodiment of the invention.

FIG. 3 illustrates a modified embodiment similar to that of FIG. 2, with the exception that the stator member 6 is the inner member, and the rotor member 7 is the outer member. As a result, the discharge opening 9 is closest to the cooling roller or conveyor 5 and the relative position of opening 9 thereto is modified during operation of the assembly.

Figure 5:
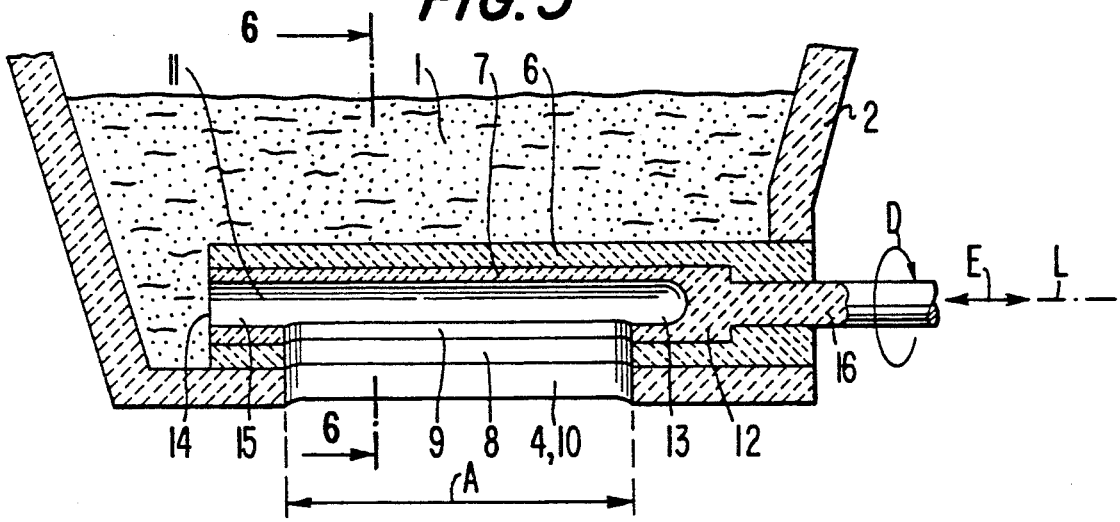
FIG. 5 is a sectional view through another embodiment of the present invention illustrated as being arranged within the interior of a metallurgical vessel on a bottom thereof.
Figure 6:
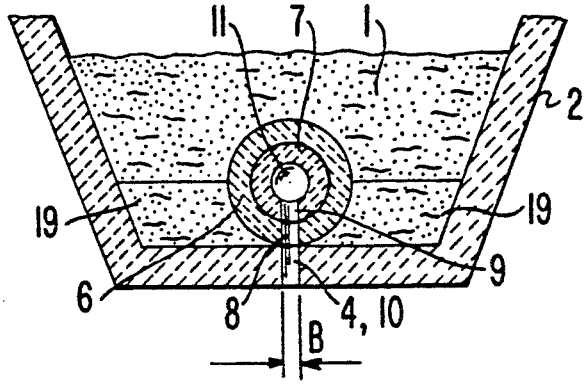
FIG. 6 is a sectional view taken along line 6—6 of FIG. 5 or of FIG. 7.

The embodiment of FIG. 5 is similar to the embodiment of FIG. 2, with the exception that the assembly is mounted within the interior of the vessel 2, and specifically on a bottom thereof such that discharge opening 8 in stator member 6 aligns with a similarly shaped discharge opening 10 in the vessel bottom that essentially forms a discharge spout 4. Otherwise, the embodiment of FIG. 5 operates in the same manner as the embodiment of FIG. 2. That is, rotor member 7 is rotatable about axes L as shown by arrow D, and also is movable in opposite directions E along axes L, thereby to close and/or regulate the discharge of molten metal. As shown in FIG. 6, supporting ribs 19 may be provided at the bottom of the vessel to aid in supporting the assembly on the bottom thereof.

Figure 7:
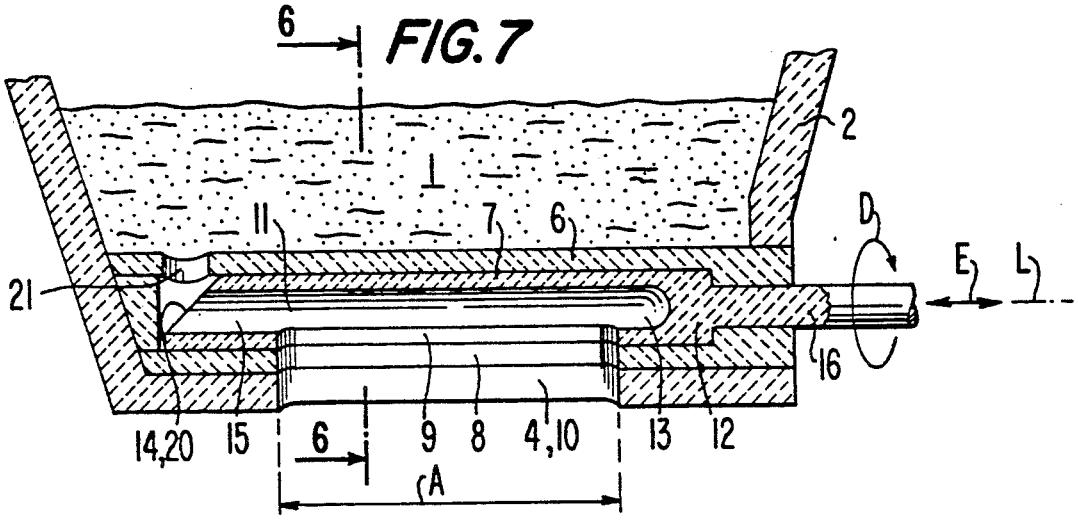
FIG. 7 is a view similar to FIG. 5 but illustrating a modified embodiment thereof.

The embodiment of FIG. 7 is similar to the embodiment of FIG. 5, with the exception of the structure forming an inlet opening 14 and the passage of molten metal thereto. Thus, the end of the rotor member 7 through which axially extends inlet opening 14 is defined by a surface 20 that is inclined to axes L. Furthermore, the longitudinal end of the outer stator member 6 has therethrough an inlet opening 21 extending radially of axes L. Inlet opening 21 is located at the same position as the inlet opening 14 axially of the assembly. Inlet opening 21 however is substantially spaced axially of discharge openings 8, 9. This embodiment has the advantage that it is possible to position both opposite ends of the assembly adjacent or against internal walls of the vessel 2, thereby improving stability of the assembly. It further would be possible to design inclined surface 20 to interact with inlet opening 21 in such a manner than when the rotor member 7 is moved to its closed position, then the rotor member 7 also would close inlet opening 21. It furthermore is possible to design inclined surface 20 to be stepped.

Figure 8:
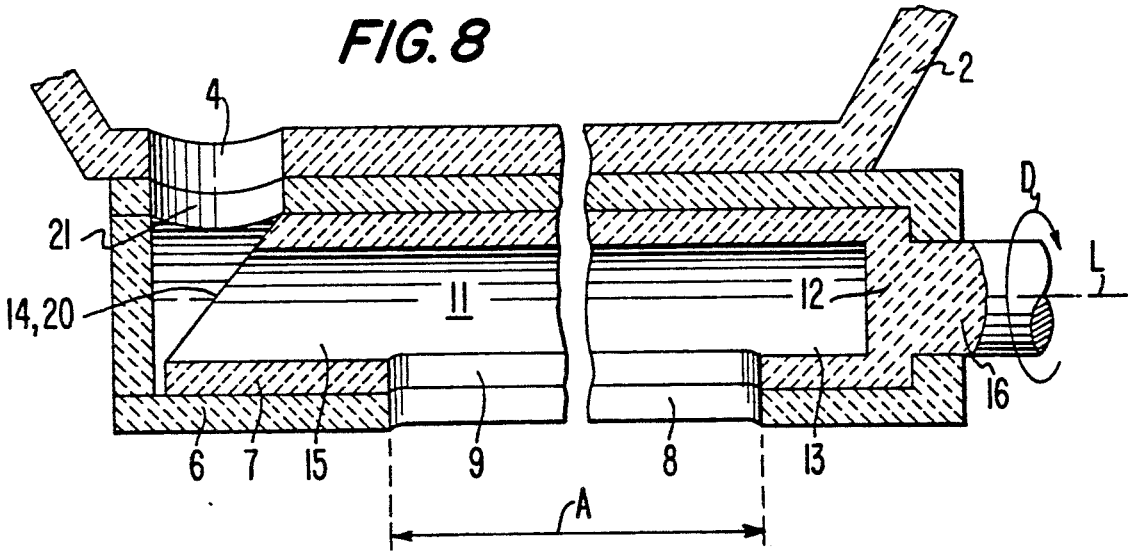
FIG. 8 is a sectional view of an embodiment of the invention similar to that of FIG. 7 but mounted exteriorly of a metallurgical vessel on a bottom thereof.

The embodiment of FIG. 8 is similar to the embodiment of FIG. 7, with the exception that the assembly is also mounted on the exterior of the vessel, similar to the embodiments of FIGS. 2 and 3, but in this case below the bottom of the vessel. More particularly, the outer stator member 6 has therethrough, similar to the embodiment of FIG. 7, a radial inlet opening 21 that aligns with a discharge spout 4 through the bottom of the vessel. The embodiment of FIG. 8 has the advantage that the static pressure of the molten metal in assembly 3 is increased compared to the embodiments of FIGS. 1 and 5. This can improve the uniform distribution of pressure of the molten metal throughout the length A of the elongated discharge openings 8, 9. Furthermore, the design of the embodiment of FIG. 8 is more compact than the design of the embodiment of FIG. 2.

In all of the above discussed embodiments of the present invention, the inner member, i.e. the stator member 6 in FIG. 3 and the rotor member 7 in the other embodiments, has therein in internal cavity 11 that is elongated in the direction of axes L and into which opens the elongated discharge opening, 8 or 9, of the inner member. A first longitudinal end of cavity 11 is closed by an end wall 12 of the inner member. A second, opposite longitudinal end of cavity 11 is opened axially through inlet opening 14 in the respective longitudinal end of the inner member. Inlet opening 14 communicates with discharge opening 8 or 9 of the inner member via the cavity 11. In other words, the molten metal entering through inlet opening 14 flows axially through cavity 11 to the discharge openings 8 and 9.

In all embodiments of the present invention, the internal cavity 11 of the inner member includes a flow zone 15 that extends in the direction of axes L between inlet opening 14 and that longitudinal end of the discharge opening 8 or 9 of the inner member that is closest to inlet opening 14. In other words, there exists, in all embodiments of the assembly of the present invention, a substantial longitudinal or axial dimension of zone 15 between inlet opening 14 and the elongated discharge opening 8 or 9 of the inner member. This tends to orient the flow of the molten metal from inlet opening 14 in a direction toward closed end 12. This in turn tends to ensure that the pressure of the molten metal will be substantially equal throughout the elongated length of the discharge openings 8, 9. As a result, the thickness of the molten metal strip discharged through the elongated discharge openings will tend to be more uniform. For similar reasons, cavity 11 preferably includes, in all embodiments of the present invention, an accumulation chamber 13 between end wall 12 and that longitudinal end of discharge opening 8 or 9 of the inner member that is closest to end wall 12. Accumulation chamber 13 again contributes to the equalization or substantial equalization of the pressure of the molten metal through the length of discharge openings 8, 9. Since chamber 13 is positioned between closed end wall 12 and the closest adjacent end of the opening 8 or 9, accumulation chamber 13 can have extending therefrom an air vent.

In the embodiments of FIGS. 2, 3 and 5, the longitudinal end of the outer member does not in any way disturb or affect the flow of molten metal into inlet opening 14 of the inner member. In the embodiments of FIGS. 7 and 8, inlet opening 21 of the outer member directs the flow of molten metal radially to inlet opening 14 of the inner member, and flow zone 15 thereafter imparts a longitudinal orientation to the flow of the molten metal.

In the above described embodiments, elongated discharge openings 8, 9 are opened downwardly. It also would be possible to provide such openings to open laterally.

Furthermore, the elongated discharge openings 8, 9 are shown as being longitudinally continuous. If desirable, for strength reasons, such elongated discharge openings can have thereacross axially spaced strengthening ribs that would not have any significant adverse affect on the discharge therefrom of the molten metal strip.

Further, in the embodiments of FIGS. 2, 3 and 8, since the assembly is mounted on the exterior of the metallurgical vessel, it is possible to provide a heater to heat the assembly, specifically the outer member thereof, to reduce the possibility of freezing of the melt within the assembly.

Although the present invention has been described and illustrated with respect to preferred embodiments thereof, it is to be understood that various modifications and changes may be made to the specifically described and illustrated features without departing from the scope of the present invention.

I claim:

1. A refractory tubular stator member for use with a refractory tubular rotor member to form an elongated nozzle assembly for closing or regulating the discharge from a metallurgical vessel of molten metal in the form of a wide strip, said stator member comprising:

a tubular wall having extending therethrough a discharge opening in the form of a slot elongated in the direction of a longitudinal axis of said stator member;

said tubular wall having inner and outer surfaces, said inner surface defining a cylindrical sealing surface capable of and forming means for sealing in a molten metal-tight manner with a complementary surface of the rotor member; and said stator member having axially spaced longitudinal ends, one said longitudinal end having therein an inlet opening and the other said longitudinal end having centrally therethrough an opening capable of receiving a portion of the rotor member.

2. A stator member as claimed in claim 1, wherein said inlet opening in said one longitudinal end of said stator member extends axially into the interior of said tubular wall.

3. A stator member as claimed in claim 2, further comprising a flange extending outwardly from said tubular wall at said one longitudinal end.

4. A stator member as claimed in claim 1, wherein said inlet opening in said one longitudinal end of said stator member extends radially through said tubular wall.

5. A refractory tubular rotor member for use with a refractory tubular stator member to form an elongated nozzle assembly for closing or regulating the discharge from a metallurgical vessel of molten metal in the form of a wide strip, said rotor member comprising:

a tubular wall having extending therethrough a discharge opening in the form of a slot elongated in the direction of a longitudinal axis of said rotor member;

said tubular wall having inner and outer surfaces, one of said surfaces defining a cylindrical sealing surface capable of and forming means for sealing in a molten metal-tight manner with a complementary surface of the stator member; and said rotor member having axially spaced longitudinal ends, one said longitudinal end being defined by a surface inclined to said axis and having therein an inlet opening and the other said longitudinal end being closed by an end wall of said rotor member.

6. A rotor member as claimed in claim 5, wherein said sealing surface comprises said outer surface of said tubular wall.

7. A rotor member as claimed in claim 6, wherein said inner surface of said tubular wall defines a cavity elongated in the direction of said axis of said rotor member and into which opens said discharge opening, said cavity has a first longitudinal end closed by said end wall and a second longitudinal end open axially through said inlet opening, and said inlet opening communicates via said cavity with said discharge opening.

8. A rotor member as claimed in claim 7, wherein said cavity includes a flow zone extending in said direction of said axis between said inlet opening and that longitudinal end of said discharge opening closest to said inlet opening.

9. A rotor member as claimed in claim 7, wherein said cavity includes an accumulation chamber between said end wall and that longitudinal end of said discharge opening closest to said end wall.

10. A rotor member as claimed in claim 7, wherein said other longitudinal end includes a control portion to enable rotation of said rotor member.

11. A stator member as claimed in claim 1, wherein said tubular wall has extending therethrough only a single said slot.

12. A rotor member as claimed in claim 5, wherein said tubular wall has extending therethrough only a single said slot.

* * * * *